US007767029B2

(12) United States Patent
Lee

(10) Patent No.: US 7,767,029 B2
(45) Date of Patent: Aug. 3, 2010

(54) DISHWASHER AND METHOD OF CONTROLLING THE SAME

(75) Inventor: Jhe Hyouk Lee, Kimhae-si (KR)

(73) Assignee: LG Electronics Inc., Seoul (KR)

( * ) Notice: Subject to any disclaimer, the term of this patent is extended or adjusted under 35 U.S.C. 154(b) by 773 days.

(21) Appl. No.: 11/483,851

(22) Filed: Jul. 11, 2006

(65) Prior Publication Data

US 2007/0006898 A1 Jan. 11, 2007

(30) Foreign Application Priority Data

Jul. 11, 2005 (KR) ..... 10-2005-0062242

(51) Int. Cl.
*B08B 9/20* (2006.01)

(52) U.S. Cl. ..... 134/57 D; 134/56 D

(58) Field of Classification Search ..... 34/72, 34/73

See application file for complete search history.

(56) References Cited

U.S. PATENT DOCUMENTS 3,068,877 A * 12/1962 Jacobs ..... 134/99.1
4,097,307 A * 6/1978 Geiger ..... 134/10
5,337,500 A * 8/1994 Enokizono ..... 34/77
5,355,900 A * 10/1994 Sakata ..... 134/95.2
2004/0200508 A1* 10/2004 Jung et al. ..... 134/25.2

FOREIGN PATENT DOCUMENTS

DE 19946456 A1 * 4/2001

OTHER PUBLICATIONS

Machine Translation of Japanese Patent Application Publication No. 11-346982 by Takahagi et al., published Dec. 1999.*
Machine Translation of Japanese Patent Application Publication No. 08-191788 by Kai et al., published Jul. 1996.*
Machine Translation of Japanese Patent Application Publication No. 09-117405 by Hamaguchi et al., published May 1997.*
Translation of Abstract of Japanese Patent Application Publication No. 03-215231 by Hamaguchi et al., published Sep. 1991.*
Machine Translation of DE19946456 A1 by Sipple et al., published Apr. 2001.*

* cited by examiner

*Primary Examiner*—Michael Kornakov
*Assistant Examiner*—Ryan Coleman
(74) *Attorney, Agent, or Firm*—McKenna Long & Aldridge LLP

(57) ABSTRACT

A dishwasher includes a drying fan formed on a side of the door to suck wet-vapor existing in a tub, a fan driving motor for rotating the drying fan, a sump formed on a bottom of the tube to reserve washing water, a drain motor for draining the washing water out of the sump, and a control unit for controlling the fan driving motor as well as the drain motor. The control unit controls the operation of the drain motor while the fan driving motor operates.

3 Claims, 8 Drawing Sheets

DISHWASHER AND METHOD OF CONTROLLING THE SAME

This application claims the benefit of Korean Patent Application No. 10-2005-0062242, filed on Jul. 11, 2005, which is hereby incorporated by reference for all purposes as if fully set forth herein.

BACKGROUND OF THE INVENTION

1. Field of the Invention

The present invention relates to a dishwasher, and more particularly, to a dishwasher that improves a drying efficiency during a drying cycle and a method of controlling the same.

2. Description of the Related Art

Generally, a dishwasher is a machine that washes dishes using washing water sprayed from upper and lower nozzles installed inside a tube.

FIG. 1 is a sectional view of a conventional dishwasher performing a drying cycle for drying dishes.

Referring to FIG. 1, a conventional dishwasher includes a tub defining a washing chamber, a door 18 provided on a front portion of the tub 11 to open and close the washing chamber, and a blower fan 3 mounted in the door 18 to exhaust hot air out of the washing chamber.

The door 18 is provided with an air outlet passage 4 in which the blower fan 3 is received. The tub 1 is provided with an air intake hole 6 through which outer air is introduced into the tub 1. A rack 5 for receiving dishes 7 is disposed in the tub 1.

An air outlet cover 8 provided with a plurality of air outlet holes is disposed on an inlet of the air outlet passage 4.

The drying cycle will now be described.

For a point when the rinsing cycle is finished and the drying cycle starts, external air is introduced through the air intake hole 6 and collides with the dishes. Then, the air is exhausted to the external side by the blower fan 3.

Meanwhile, since the air exhausted through the air outlet passage 4 is in a high-temperature/high-humidity state, the user may be burnt when his/her body is about the exhaust hole 4.

In addition, during the drying cycle, the water adhered to the dishes falls to the bottom of the tub 11 or is collected in the sump provided on the bottom of the tub 11. In this case, due to the water collected in the sump, the drying efficiency may be deteriorated.

SUMMARY OF THE INVENTION

Accordingly, the present invention is directed to a dishwasher and a method of controlling the same that substantially obviate one or more problems due to limitations and disadvantages of the related art.

An object of the present invention is to provide a dishwasher that is improved in the drying efficiency and a method of controlling the dishwasher.

To achieve these objects and other advantages and in accordance with the purpose of the invention, as embodied and broadly described herein, there is provided a dishwasher including; a drying fan formed on a side of the door to suck wet-vapor existing in a tub; a fan driving motor for rotating the drying fan; a sump formed on a bottom of the tube to reserve washing water; a drain motor for draining the washing water out of the sump; and a control unit for controlling the fan driving motor as well as the drain motor, wherein the control unit controls the operation of the drain motor while the fan driving motor operates.

In another aspect of the present invention, there is provided a method of controlling a dishwasher having a sump for reserving washing water and a drain motor for draining the washing water out of the sump, the method including: starting a drying cycle for drying dishes loaded in a tub; rotating a fan for exhausting wet-vapor existing in the tub to an external side; and operating the drain motor for a predetermined time while the fan rotates.

According to the present invention, since the washing water is drained out of the sump during the drying cycle, the increase of the humidity in the tub can be prevented.

In addition, since the washing water is drained out of the sump during the drying cycle, the time required for drying the dishes can be reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
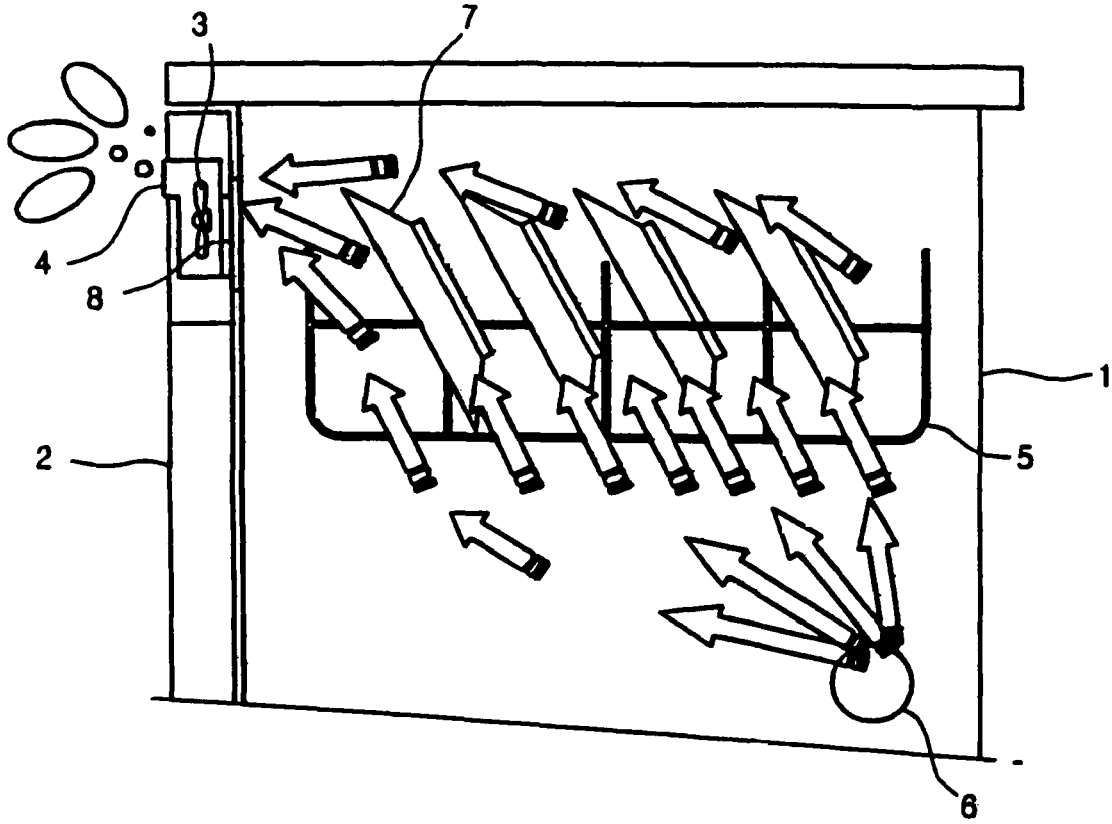
FIG.1 PRIOR ART
FIG. 1 is a sectional view illustrating a process for drying dishes in a conventional dishwasher.
Figure 2:
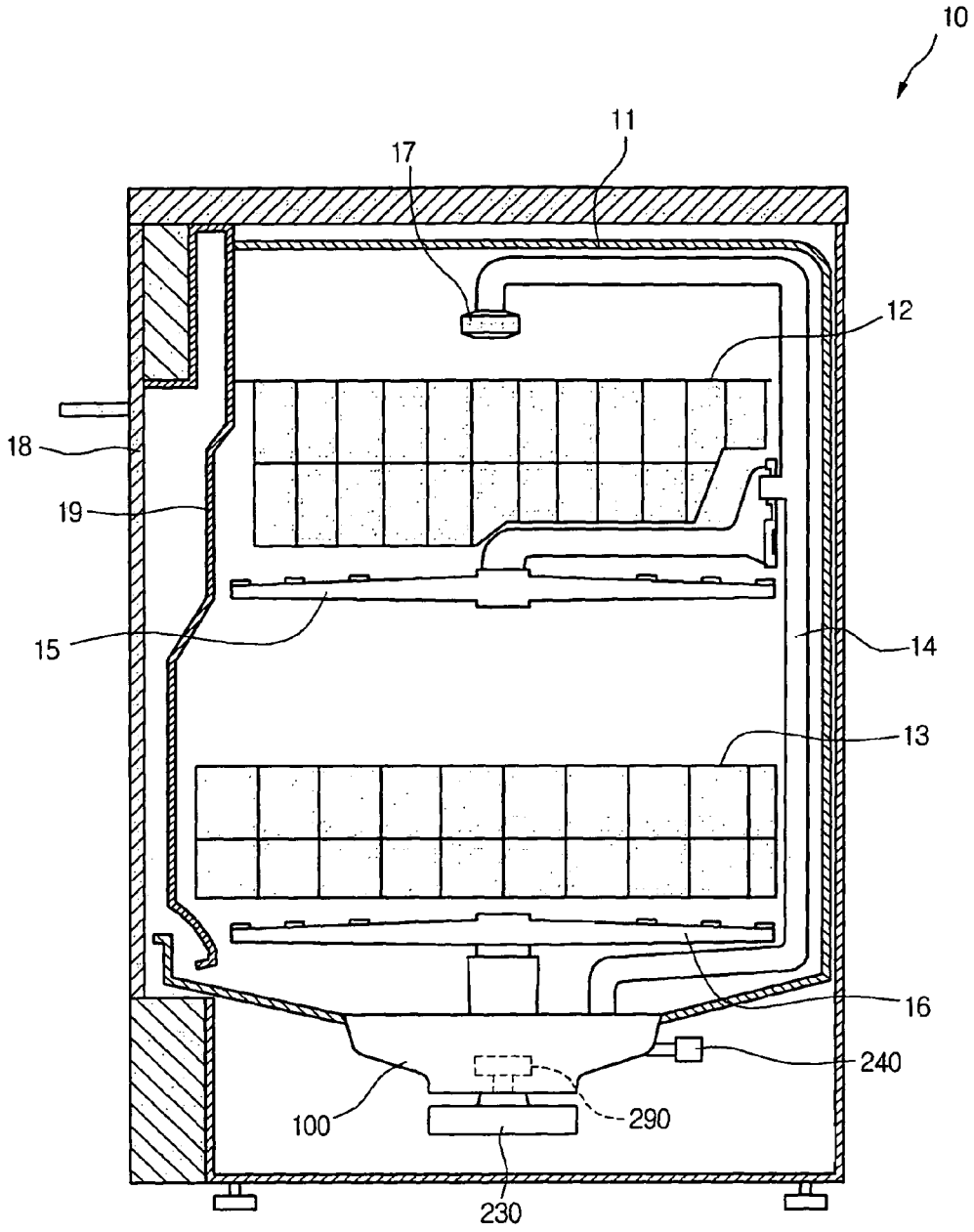
FIG. 2 is a sectional view of a dishwasher according to an embodiment of the present invention.

FIG. 2 is a sectional view of a dishwasher according to an embodiment of the present invention.

Referring to FIG. 2, a dishwasher 10 includes a tub 11 defining a washing chamber, a door provided on a front portion of the tub 11 to open and close the washing chamber, and a sump 100 mounted on a bottom-center of the tub 11 and reserving washing water therein.

The door includes a door cabinet 18 disposed on an outer portion of the dishwasher 10 and a door liner 19 spaced apart from the door cabinet 18.

The dishwasher 10 further includes a washing motor 230 for driving a washing pump 290 mounted in the sump 100, a water guide 14 defining a path along which washing water pumped out by the washing pump flows, a lower nozzle 16 coupled to a top of the sump 100 to spray the washing water upward and/or downward in the washing chamber, an upper nozzle 15 extending from a portion of the water guide 14 toward a center of the tub 11, and a top nozzle 17 extending from a top of the water guide 14 and located near a ceiling of the tub 11 to spray the washing water downward.

The washing water reserved in the sump 100 is pumped out by the washing pump 290 and directed to the lower nozzle 16 or the water guide 14.

The washing water collected in the sump 100 is drained out of the dishwasher 100 by a drain pump driven by a drain motor 240.

The drain motor 240 is generally operated at a point where each cycle such as a washing cycle or a rinsing cycle is finished. However, sometimes, the drain pump 240 may be operated during the drying cycle for removing the water from the dishes loaded in the washing chamber. This will be described in more detail later.

The dishwasher 10 further includes an upper rack 12 placed right above the upper nozzle 15 and a lower rack 13 disposed right above the lower nozzle 16. That is, the dishes received on the upper rack 12 are washed by the washing water sprayed from the upper and top nozzles 15 and 17. The dishes received on the lower rack 13 are washed by the washing water sprayed from the lower nozzle 16.

The operation of the dishwasher 10 will now be described.

The door 18 is first opened and the upper rack 12 and/or lower rack 13 are withdrawn out of the dishwasher 10. The dishes are arranged on the racks 12 and 13. Then, the racks 12 and 13 are returned to their initial locations and the door 18 is closed. The power is turned on to wash the dishes received in the racks 12 and 13.

Meanwhile, when the power is turned on, the washing water is supplied from a water source (not shown) into the sump 100. After a predetermined amount of the washing water is supplied into the sump 100, the washing motor 230 operates. At this point, an impeller (not shown) connected to a motor shaft of the washing motor 230 and disposed in the washing pump 290 rotates to pump out the washing water and direct the pumped washing water to the lower nozzle 16 or the water guide 14.

The washing water directed to the water guide 14 is sprayed into the washing chamber via the top and upper nozzles 17 and 15. The washing water sprayed from the top and upper nozzles 17 and 15 washes the dishes arranged in the racks 12 and 13.

The washing water sprayed upward from the lower nozzle 16 washes the dishes arranged in the lower rack 13.

The foreign objects generated during the washing cycle are filtered off by a filter (not shown) provided in the sump 100. When the washing process is finished, the drain motor operates to drain the used washing water and the foreign objects out of the dishwasher 10.

When the used washing water is drained, rinsing water is supplied to the sump 100 and sprayed through the nozzles 15 and 16 to perform a rinsing process. When the rinsing process is finished, a drying process is performed to finalize the washing process.

The rinsing water may be heated by a heater installed in the sump 100 to enhance the rinsing efficiency.

When the rinsing cycle is finished, the drying cycle is performed to complete the washing of the dishes. In the drying cycle, a fan mounted on a front portion of the door liner 19 rotates to exhaust the hot air out of the washing chamber. At this, wet-vapor is also exhausted out of the tub 11.

During the drying cycle, the drain pump 240 is intermittently driven at a predetermined time interval. This is to drain the used washing water that may be collected in the sump 100 to the external side.

Therefore, since the collection of the high temperature water in the sump 100 can be prevented during the drying cycle, the deterioration of the drying efficiency due to the vapor generated from the high temperature water can be prevented.

Figure 3:
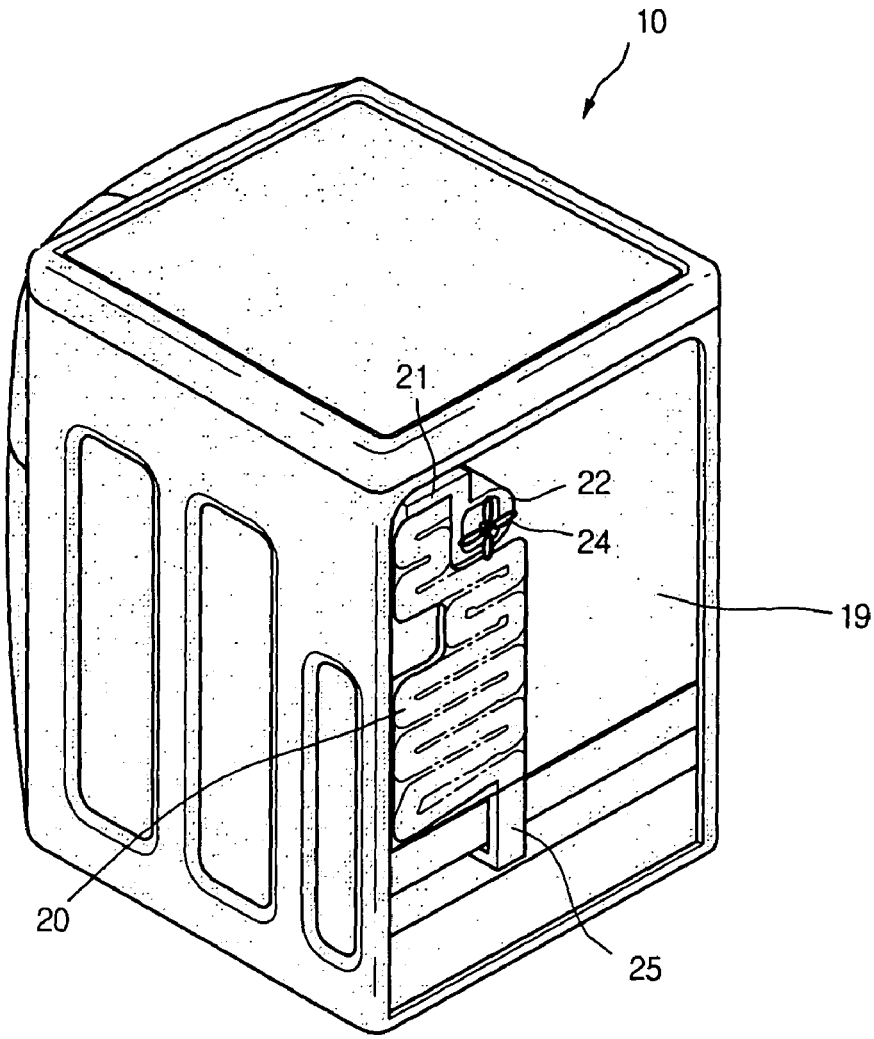
FIG. 3 is a view of a condensing apparatus of the dishwasher of FIG. 2.
Figure 4:
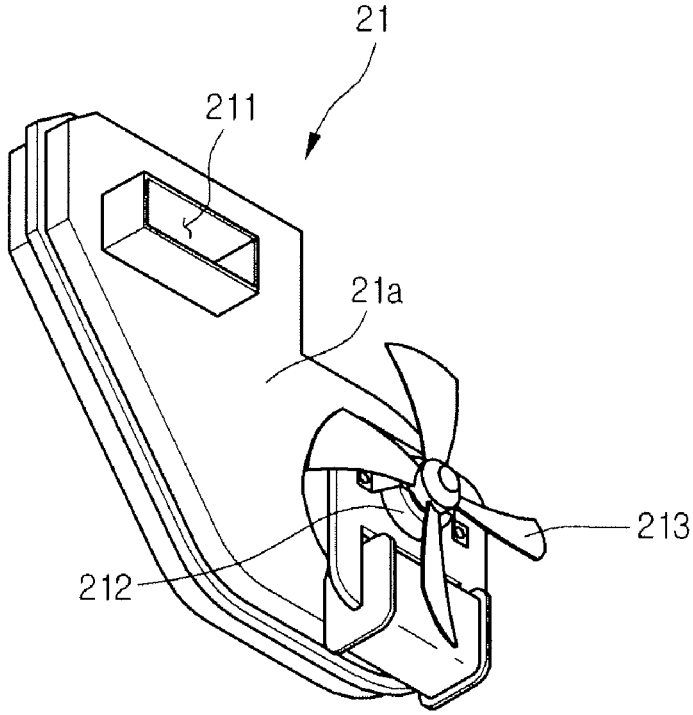
FIG. 4 is a front perspective view of a blower of the condensing apparatus of FIG. 3.
Figure 5:
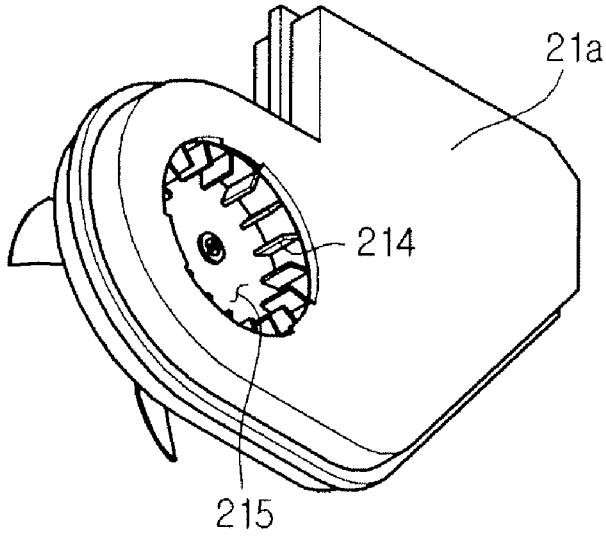
FIG. 5 is a rear perspective view of the blower of FIG. 4.

FIG. 3 is a view of a condensing apparatus of the dishwasher of FIG. 2, FIG. 4 is a front perspective view of a blower of the condensing apparatus of FIG. 3, and FIG. 5 is a rear perspective view of the blower of FIG. 4.

Referring first to FIG. 3, a condensing apparatus of the dishwasher condenses the wet-vapor formed in the tub 11 and collects the condensed water in the sump 100. The condensing apparatus is installed on a front portion of the liner 19 and protected by the door cabinet 18.

That is, the condensing apparatus includes a blower 21 installed on an upper portion of the door liner 19 to suck the wet-vapor formed in the tub 4 and a condensing duct 22 connected to the blower 21 to condense the wet-vapor.

Therefore, the wet-vapor sucked by the blower 21 flows along the condensing duct 20.

The condensing apparatus further includes a condensing fan 24 installed on a front portion of the blower 21 to send cool air for lowering the temperature of the wet-vapor.

One end of the condensing duct 20 extends into the tub 11 to allow the condensed water falls to the bottom of the tub 11.

During the drying cycle, the wet-vapor leaving the tub 11 flows to the condensing duct 20 via the blower 21. The wet-vapor is condensed while flowing along the condensing duct 20 and falls to the bottom of the tub 11.

In this case, the condensed water on the bottom of the tub 11 flows into the sump 100 and is then drained to the external side by the operation of the drain motor 240.

Referring to FIGS. 4 and 5, the blower 21 for directing the wet-vapor formed in the tub 11 to the condensing duct 20 includes a drying fan 214 disposed therein and a fan driving motor 212 for driving the drying fan 214. The blower 21 includes a body 21*a* having a wet-vapor inlet 215 communicated with the washing chamber, the fan driving motor 212 mounted on the body 21*a*. The drying fan 214 is disposed within the body 21*a* and the condensing fan 24 is disposed outside of the body 21*a*.

The blower 21 further includes a condensing fan 213 formed on the front portion to send the cool air for cooling the wet-vapor flowing along the condensing duct 20.

The condensing fan 213 is connected to the rotational shaft of the drying fan 214 so that it can rotate together with the drying fan 214. The drying fan 214 and the condensing fan 213 function as a cross-flow fan for sucking the air in an axial direction and exhausting in a radial direction.

In addition, a wet-vapor outlet 211 is formed on the front portion of the blower 21 and the wet-vapor inlet 215 for introducing the wet-vapor formed in the tub 11 is formed on the rear portion of the blower 21.

As the fan driving motor 212 operates, the drying and condensing fans 214 and 213 rotate to allow the wet-vapor formed in the tub 11 to be introduced through the wet-vapor inlet 215 formed on the drying fan 214.

The wet-vapor introduced through the wet-vapor inlet 215 is exhausted through the wet-vapor outlet 211 and flows into the condensing duct 20. The wet-vapor is condensed while flowing along the condensing duct 20 and the condensed water falls to the bottom of the tub 11 and is collected in the sump 100.

As described above, by the operation of the fan driving motor 212, the drying cycle is performed. During the drying cycle, the drain motor 240 intermittently operates to drain the water collected in the sump 100 to the external side.

That is, in order to lower the humidity in the tub 11 during the drying cycle, the drain motor operates to drain the collected condensed water and the used washing water to the external side.

Figure 6:
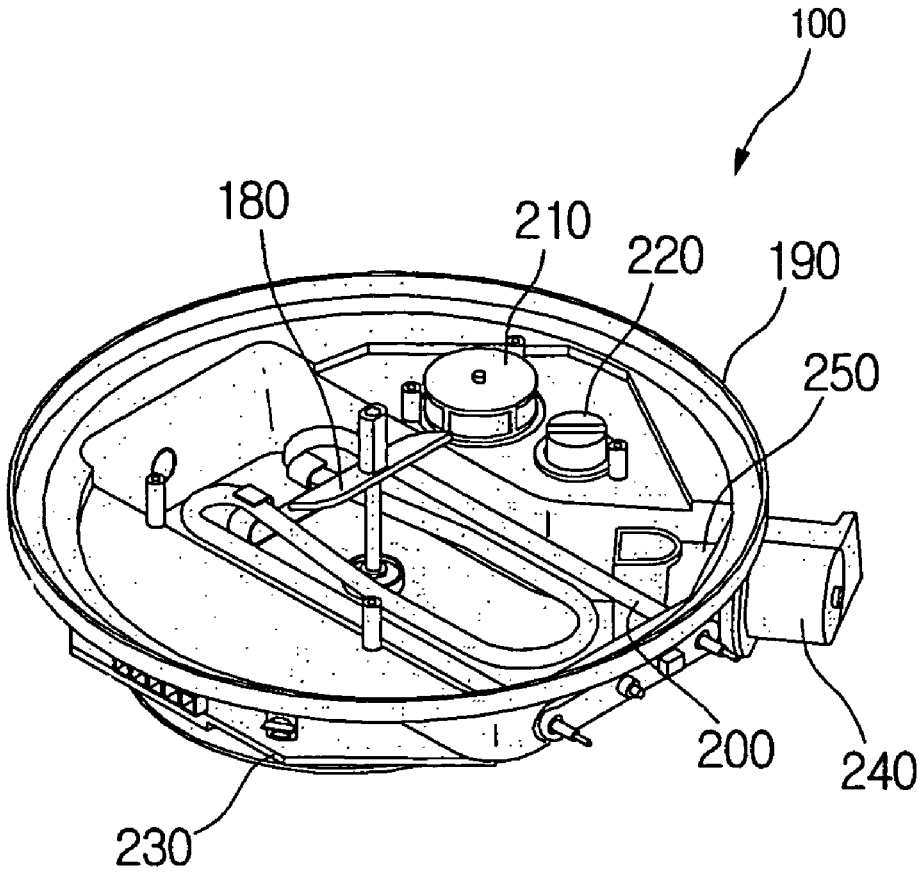
FIG. 6 is a partial view of a sump of the dishwasher of FIG. 2.

FIG. 6 is a partial view of a sump of the dishwasher of FIG. 2.

Referring to FIG. 6, the sump 100 includes a sump case 190 for reserving the washing water, a washing motor 230 mounted on a bottom of the sump case 190 to generating rotation power, and a drain pump 250 and a drain motor 240 that are mounted on a side portion of the sump case 190 to drain the washing water to an external side.

In addition, the sump 100 further includes a heater 200 mounted on an inner bottom of the sump case 190 to heat the washing water and a disposer 180 rotating together with a motor shaft 231 to grind food wastes.

The sump 100 further includes a vario valve 210 mounted on a side portion of the sump case 190 and a turbidity sensor 220 mounted near the vario valve 210.

When the drain motor 240 and the drain pump 250 operate, the washing water collected in the sump case 190 is drained to the external side. At this point, as the washing water is drained, the humidity in the dishwasher can be lowered. That is, since no washing water is in the sump, no vapor is generated from the sump 100 and supplied into the tub 11.

Figure 7:
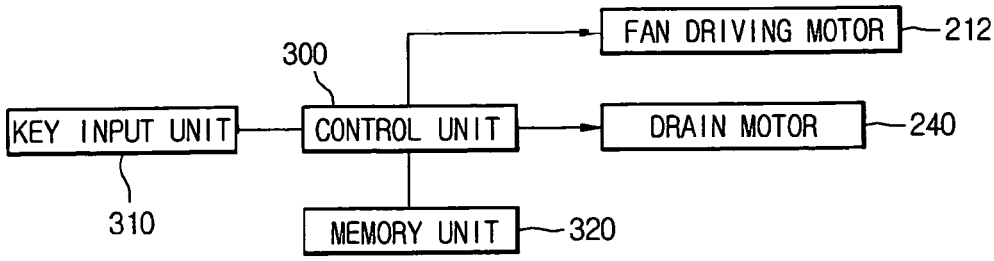
FIG. 7 is a block diagram of the dishwasher of FIG. 2.

FIG. 7 is a block diagram of the dishwasher of FIG. 2.

The dishwasher includes a key input unit 310, a control unit 300 for operating the dishwasher in response to the mode selected through the key input unit 310, a fan driving motor 212 for rotating the drying and condensing fans 215 and 213 of the blower 21 in response to the control of the control unit 300, a drain motor 240 for draining the washing water collected in the sump 100 to the external side, a memory unit 320 for storing a reference operation time and the reference number of operations of the drain motor.

That is, the control unit 300 operates the fan driving motor 212 during the drying cycle to rotate the drying and condensing fans 215 and 213 of the blower 21. Therefore, the wet-vapor generated in the tub 11 is directed to the condensing duct 20 through the drying fan 215.

The control unit 300 controls the drain motor 240 such that the drain motor 240 intermittently operates while driving the fan driving motor 212. In this case, as the drain motor intermittently operates, the washing water collected in the sump 100 is drained out of the sump 100.

In addition, the memory unit 320 stores a reference operation time and the reference number of operations of the drain motor 240 during the drying cycle. The control unit 300 controls the operation time and the number of operations of the drain motor with reference to the reference operation time and the reference number of intermittent operations.

For example, during the drying cycle, the washing and condensed water collected in the sump 100 is gradually reduced as the drying cycle is processed. Therefore, as the number of intermittent operations of the drain pump 240 increases, the operation time is gradually reduced.

For example, during the drying cycle, after the drain motor 240 operates for 1 hour, the operation of the drain motor 240 stops for a first predetermined time. Then, the drain motor 240 operates for a second predetermined time shorter than 1 hour.

The control unit 300 controls the drain motor 240 such that an RPM of the drain motor is gradually reduced as the drying cycle is processed. That is, the drain motor operates at a relatively high RPM and operates at a lower RPM as the drying cycle is processed.

Figure 8:
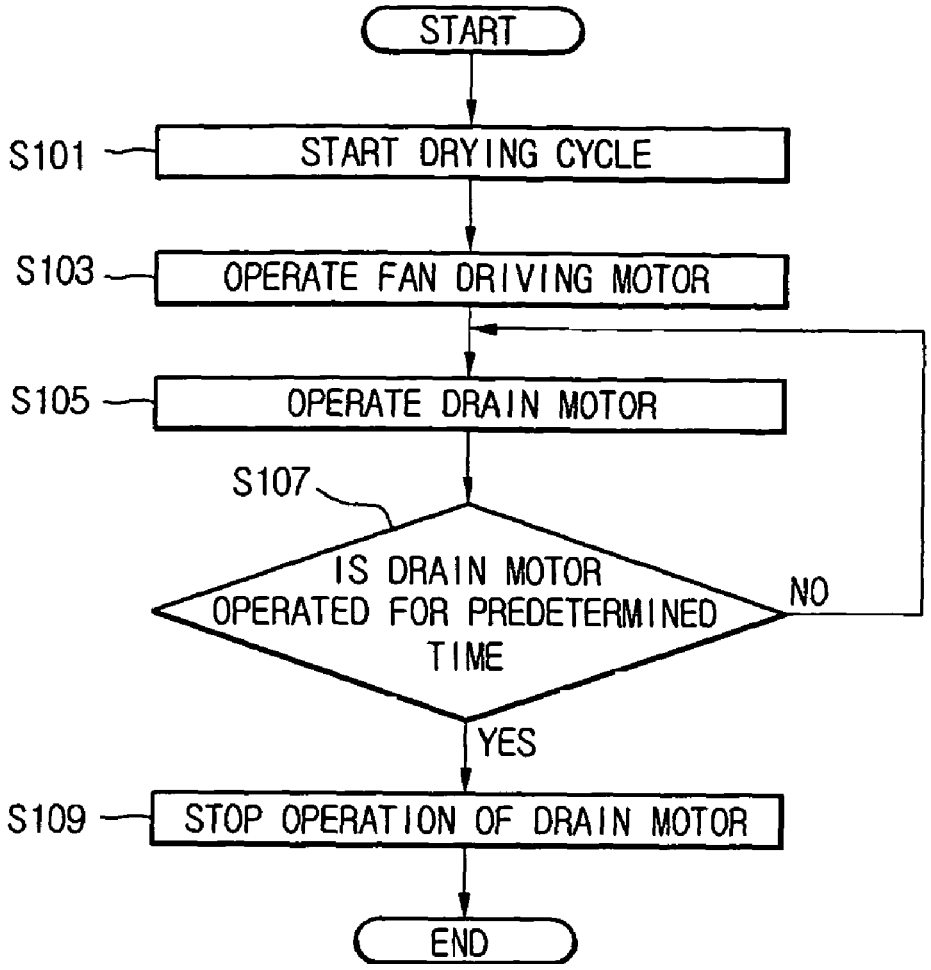
FIG. 8 is a flowchart of a method of controlling a dishwasher according to an embodiment of the present invention.

FIG. 8 is a flowchart of a method of controlling a dishwasher according to an embodiment of the present invention.

After the washing and rinsing cycles are finished, the drying cycle for drying the dishes is performed (S101).

The fan driving motor 212 of the blower 21 is driven by the control unit 300 (S103), by which the wet-vapor existing in the tub 11 is exhausted out of the tub 11 through the blower 21.

Then, the drain motor 240 is operated by the control unit 300 to drain the washing and condensed water out of the sump 100 (S105).

In this case, the control unit 300 operates intermittently the drain motor 240 at predetermined time intervals. As the number of operations of the drain motor 240 incrases, the operation time of the drain motor 240 is gradually reduced.

Then, the control unit 300 determines if the drain motor 240 operates for as long as the reference operation time (S107) as many as the reference number of operations (S107). When it is determined that the drain motor 240 operates for as long as the reference operation time (S107) as many as the reference number of operations, the control unit 300 interrupts the operation of the drain motor 240.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A dishwasher comprising;

a key input unit through which a washing mode is input;

a tub defining a washing chamber;

a door provided on a front portion of the tub to open and close the washing chamber;

a blower mounted on a side of the door to suck wet-vapor existing in the washing chamber;

a condensing duct installed inside the door and connected to the blower to condense the wet-vapor;

a sump formed on a bottom of the tub to reserve washing water;

a drain motor for draining the washing water out of the sump;

a memory unit for storing a reference operation time and the reference number of operations of the drain motor; and a control unit for controlling the drain motor, wherein the control unit controls the drain motor intermittently such that the drain motor operates for a predetermined time during a drying cycle for drying dishes, and the operation time of the drain motor is gradually reduced as the number of operations of the drain motor increases, and the blower includes:

a body having a wet-vapor inlet communicated with the washing chamber;

a fan driving motor mounted on the body;

a drying fan connected to one side of the fan driving motor for sucking the wet-vapor from the washing chamber and exhausting the wet-vapor to the condensing duct, and forming a water-vapor inlet therein; and a condensing fan connected to the other side of the fan driving motor for cooling the wet-vapor flowing along the condensing duct, wherein the drying fan is disposed within the body and the condensing fan is disposed outside of the body.

2. The dishwasher according to claim 1, wherein the control units controls the drain motor such that, after the drain motor operates for 1 hour, the operation of the drain motor is stopped for a first predetermined time, after which the drain motor operates for a second predetermined time shorter than 1 hour.

3. The dishwasher according to claim 2, wherein the control unit controls the drain motor such that a revolutions per minute of the drain motor is gradually reduced as the operation time of the drain motor has elapsed.

* * * * *